US008111273B2

(12) United States Patent
Morooka et al.

(10) Patent No.: US 8,111,273 B2
(45) Date of Patent: Feb. 7, 2012

(54) THERMAL HEAD, PRINTER, AND MANUFACTURING METHOD FOR THERMAL HEAD

(75) Inventors: Toshimitsu Morooka, Chiba (JP); Keitaro Koroishi, Chiba (JP); Yoshinori Sato, Chiba (JP); Noriyoshi Shoji, Chiba (JP); Norimitsu Sanbongi, Chiba (JP)

(73) Assignee: Seiko Instruments Inc. (JP)

( * ) Notice: Subject to any disclaimer, the term of this patent is extended or adjusted under 35 U.S.C. 154(b) by 300 days.

(21) Appl. No.: 12/586,989

(22) Filed: Sep. 30, 2009

(65) Prior Publication Data

US 2011/0074907 A1 Mar. 31, 2011

(51) Int. Cl.
*B41J 2/335* (2006.01)

(52) U.S. Cl. ..... 347/204

(58) Field of Classification Search ..... 347/204, 347/200, 205, 206, 208, 209
See application file for complete search history.

(56) References Cited

U.S. PATENT DOCUMENTS

| | | | | |
|---|---|---|---|---|
| 6,335,750 | B2 * | 1/2002 | Horiuchi et al. | 347/200 |
| 6,525,755 | B1 * | 2/2003 | Imai et al. | 347/208 |
| 7,843,476 | B2 * | 11/2010 | Morikawa et al. | 347/209 |
| 2001/0033320 | A1 * | 10/2001 | Sugiyama et al. | 347/206 |

* cited by examiner

*Primary Examiner* — Kristal Feggins
(74) *Attorney, Agent, or Firm* — Adams & Wilks

(57) ABSTRACT

To achieve improvements in heating efficiency and strength against external load, provided is a thermal head (1), comprising: a supporting substrate (3) having a surface in which a concave portion (2) is formed; a heat storage layer (5) bonded onto the surface of the supporting substrate (3); a heating resistor provided in a region, which is opposed to the concave portion (2) of the supporting substrate (3), on the heat storage layer (5); and a protruding portion (2A), which is provided inside a hollow portion formed between the supporting substrate (3) and the heat storage layer (5) by the concave portion (2), and comes into contact with the heat storage layer (5) and limits deflection of the heat storage layer (5) when the heating resistor is pressurized by predetermined load or more.

14 Claims, 16 Drawing Sheets

THERMAL HEAD, PRINTER, AND MANUFACTURING METHOD FOR THERMAL HEAD

BACKGROUND OF THE INVENTION

1. Field of the Invention

The present invention relates to a thermal head, a printer, and a manufacturing method for a thermal head.

2. Description of the Related Art

There have been conventionally known a thermal head which is used in a thermal printer often installed to a portable information equipment terminal typified by a compact hand-held terminal, and which is used to perform printing on a thermal recording medium based on printing data with the aid of selective driving of a plurality of heating elements (for example, see JP 6-166197 A).

In terms of an increase in efficiency of the thermal head, there is a method of forming a heat insulating layer below a heating portion of a heating resistor. By formation of the heat insulating layer below the heating portion, of an amount of heat generated in the heating resistor, an amount of upper-transferred heat which is transferred to an abrasion resistance layer formed above the heating portion becomes larger than an amount of lower-transferred heat which is transferred to a heat storage layer formed below the heating portion, and hence energy efficiency required during printing can be sufficiently obtained. In the thermal head described in JP 6-166197 A, a hollow portion is provided below the heating portion of the heating resistor, and this hollow portion functions as a hollow heat insulating layer. Thus, the amount of upper-transferred heat becomes larger than the amount of lower-transferred heat, and the energy efficiency is increased.

Further, in a printer in which a thermal head is installed, thermal paper is pressed, with a predetermined pressing force, against a head portion of a surface of the abrasion resistance layer formed above the heating portion by a platen roller. Therefore, the thermal head is required to have heating efficiency for improving printing quality as described above, and required to have strength for withstanding the pressing force of the platen roller.

However, in the conventional thermal head, in order to increase heat insulating performance of a substrate, the hollow portion is enlarged, and the thickness of the heat storage layer between the heating resistor and the hollow portion is thinned. As a result, when external load is applied to the heating resistor, excessive deflection occurs in the heat storage layer. Then, when tensile stress due to the deflection becomes larger than breaking stress of glass, there arises a problem that the heat storage layer breaks. Further, when large deflection occurs in the heat storage layer by the pressing force of the platen roller, a contact state between the thermal paper and the head portion is deteriorated, and contact pressure is reduced, whereby there arises a problem that it becomes difficult to transfer heat to the thermal paper.

SUMMARY OF THE INVENTION

The present invention has been made in view of the above-mentioned circumstances, and an object of the present invention is therefore to provide a thermal head, a printer, and a manufacturing method for a thermal head, in which improvements in heating efficiency and strength against external load are achieved.

In order to achieve the above-mentioned object, the present invention provides the following means.

Specifically, according to the present invention, there is provided a thermal head, comprising: a substrate having a surface in which a concave portion is formed; a heat storage layer bonded onto the surface of the substrate; a heating resistor provided in a region, which is opposed to the concave portion of the substrate, on the heat storage layer; and a deflection limiting portion, which is provided inside a hollow portion formed between the substrate and the heat storage layer by the concave portion, and comes into contact with the heat storage layer and limits deflection of the heat storage layer when the heating resistor is pressurized by predetermined load or more.

According to the present invention, the hollow portion functions as a hollow heat insulating layer, and hence it is possible to suppress transfer of heat generated in the heating resistor to the substrate through the heat storage layer. Thus, an amount of heat transferred above the heating resistor and used for printing and the like is increased, and it is possible to improve heating efficiency.

Further, when excessive load is applied to the heating resistor, the deflection limiting portion comes into contact with the heat storage layer, whereby the deflection of the heat storage layer is limited. With this structure, it is possible to prevent breakage of the heat storage layer.

In the above-mentioned invention, the deflection limiting portion may be formed into a shape protruding from a bottom surface of the hollow portion toward the heat storage layer, and the deflection limiting portion and the heat storage layer may have a gap therebetween of a size allowing the heat storage layer to come into contact with the deflection limiting portion within a range in which the heat storage layer is elastically deformed.

With this structure, when the deflection occurs in the heat storage layer, the heat storage layer comes into contact with the deflection limiting portion, whereby deformation of the heat storage layer can remain within the range in which the heat storage layer is elastically deformed. Further, normally, the gap is formed between the deflection limiting portion and the heat storage layer, and hence it is possible to maintain high heat insulating performance. Note that, the deflection limiting portion may have a protruding columnar shape, or a protruding wall-like shape.

Further, in the above-mentioned invention, the gap between the deflection limiting portion and the heat storage layer may be set to approximately 0.1 μm or more and 1 μm or less, and the heat storage layer enclosing an opening of the concave portion may have a thickness of approximately 10 μm or less.

Further, in the above-mentioned invention, a peripheral edge of the concave portion in the surface of the substrate may be formed as a curved surface which is curved toward an inside of the concave portion in a direction of being gradually apart from the heat storage layer.

With this structure, in a case where external load is applied to the heat storage layer enclosing the opening of the concave portion, and the deflection occurs, it is possible to alleviate concentration of stress applied to the heat storage layer at the periphery of the concave portion of the surface of the substrate.

According to the present invention, there is provided a printer, comprising: the thermal head according to the first aspect of the present invention; and a pressure mechanism for pressing an object to be printed against a heating resistor of the thermal head.

According to the present invention, it is possible to increase heating efficiency of the thermal head, and to reduce power consumption at a time of performing printing on the object to be printed. Further, by the deflection limiting portion, the deflection of the heat storage layer due to a pressing force of the pressure mechanism is limited, whereby it is possible to prevent the breakage of the heat storage layer, and to transfer heat by causing the heating resistor to reliably come into contact with the object to be printed. Therefore, it is possible to perform printing with low power and excellent printing quality.

According to the present invention, there is provided a manufacturing method for a thermal head, comprising: a concave portion forming step of forming, on a surface of a substrate, a concave portion having a protruding portion on a bottom surface thereof; a bonding step of thermally fusing a heat storage layer on the surface of the substrate, in which the concave portion is formed in the concave portion forming step; and a heating resistor forming step of forming a heating resistor on the heat storage layer so that the heating resistor is opposed to the concave portion, wherein, in the bonding step, a gap is formed between the protruding portion and the heat storage layer at a time of the thermal fusion with use of expansion of gas in the concave portion and softening of the substrate and the heat storage layer.

According to the present invention, in the bonding step, the concave portion of the substrate formed in the concave portion forming step is covered with the heat storage layer, whereby a hollow portion is formed between the substrate and the heat storage layer. The hollow portion functions as a hollow heat insulating layer, and suppresses the transfer of heat generated in a heating portion of the heating resistor to the substrate through the heat storage layer, and hence it is possible to manufacture the thermal head having high energy efficiency. Further, a thickness of the hollow portion is determined based on a depth of the concave portion, and hence it is possible to easily control a thickness of the hollow heat insulating layer.

Further, in the bonding step, the gap is formed between the protruding portion and the heat storage layer when the substrate and the heat storage layer are thermally fused to each other, whereby it is possible to omit a special step of forming the gap. Therefore, the number of manufacturing steps is reduced, and manufacture of the thermal head can be simplified.

In the above-mentioned invention, in the bonding step, the gap may be formed so that the heat storage layer comes into contact with the protruding portion within a range in which the heat storage layer is elastically deformed.

With this structure, it is possible to manufacture the thermal head in which the breakage of the heat storage layer is prevented.

Further, in the above-mentioned invention, in the bonding step, a periphery of the concave portion in the surface of the substrate may be formed as a curved surface which is curved toward an inside of the concave portion in a direction of being gradually apart from the heat storage layer.

With this structure, even when the external load is applied to the heat storage layer enclosing the opening of the concave portion, and the deflection occurs, it is possible to manufacture the thermal head in which there is alleviated concentration of stress applied to the heat storage layer at the periphery of the concave portion of the surface of the substrate.

According to the present invention, it is possible to provide an effect that improvements in heating efficiency and strength against the external load can be achieved.

DETAILED DESCRIPTION OF THE PREFERRED EMBODIMENTS

First Embodiment

Hereinafter, a printer 10 and a thermal head 1 according to a first embodiment of the present invention are described with reference to drawings.

Figure 1:
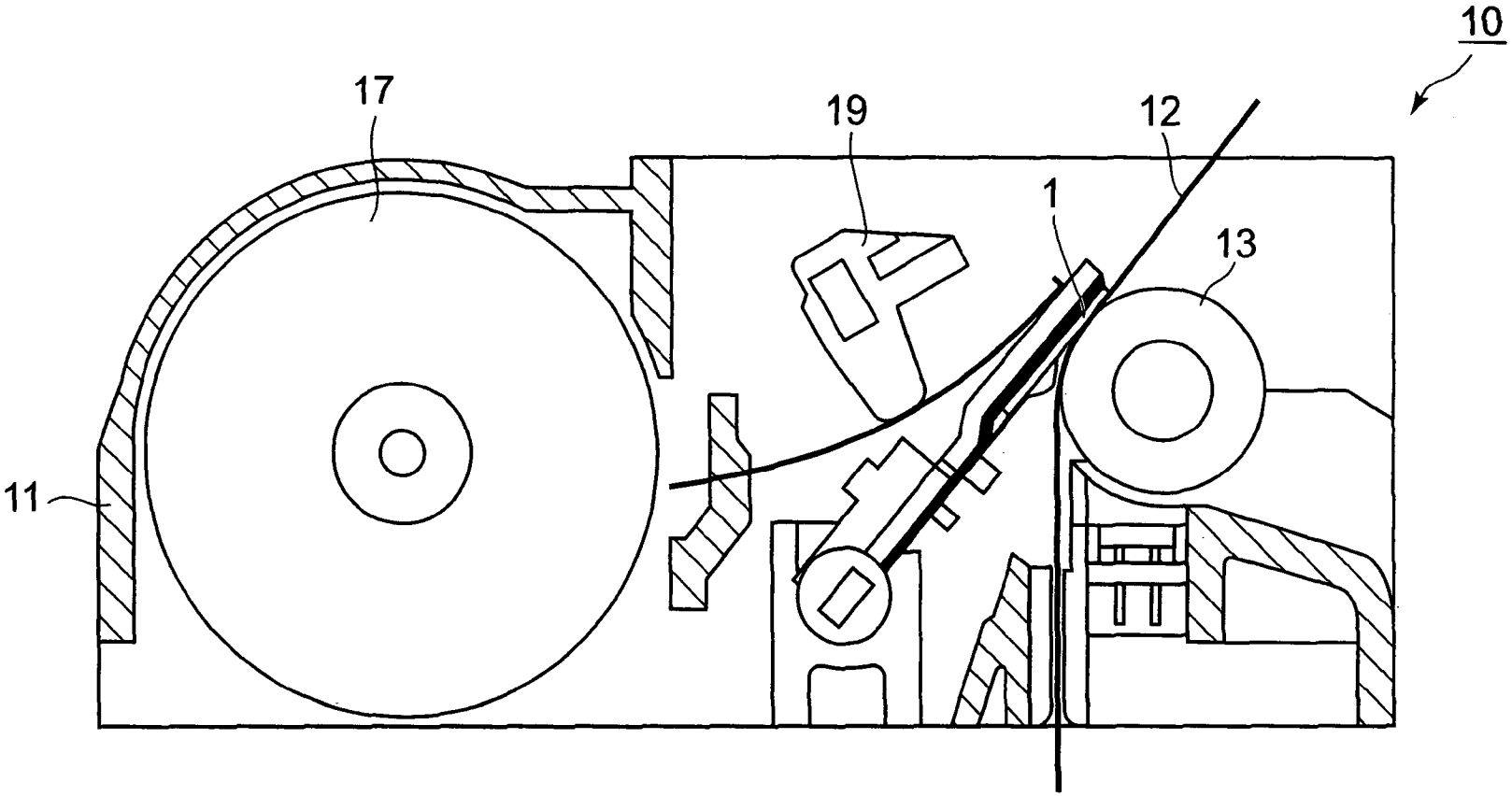
FIG. 1 is a schematic view of a structure of a thermal printer according to a first embodiment of the present invention.

The thermal printer 10 according to this embodiment includes: as illustrated in FIG. 1, a main body frame 11; a platen roller 13 arranged horizontally; a thermal head 1 arranged oppositely to an outer peripheral surface of the platen roller 13; a heat dissipation plate 15 (see FIG. 3) supporting the thermal head 1; a paper feeding mechanism 17 for feeding between the platen roller 13 and the thermal head 1 an object to be printed such as thermal paper 12; and a pressure mechanism 19 for pressing the thermal head 1 against the thermal paper 12 with a predetermined pressing force.

Against the platen roller 13, the thermal head 1 and the thermal paper 12 are pressed by the operation of the pressure mechanism 19. With this, load of the platen roller 13 is applied to the thermal head 1 through an intermediation of the thermal paper 12.

The heat dissipation plate 15 is a plate-shaped member made of metal such as aluminum, a resin, ceramics, glass, or the like, and serves for fixation and heat dissipation of the thermal head 1.

Figure 2A:
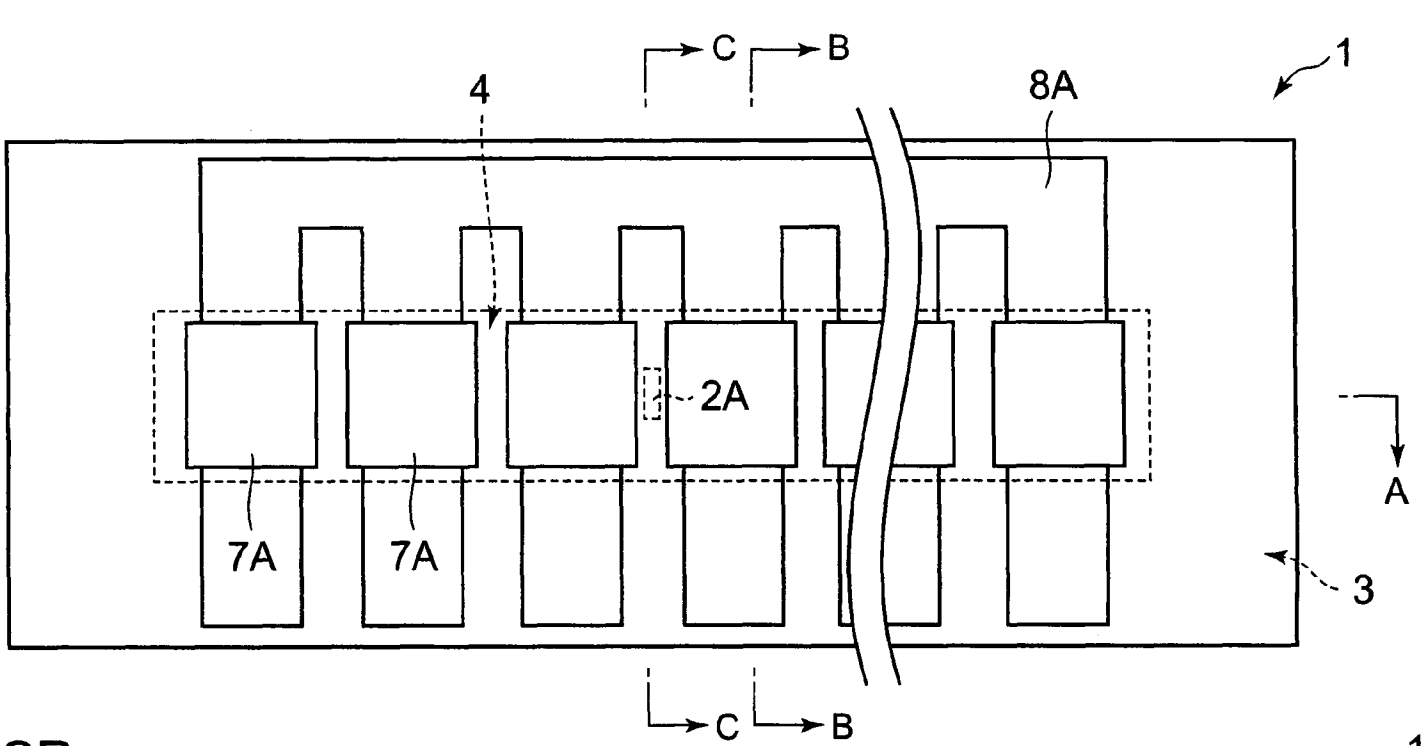
FIG. 2A is a plane view of a thermal head of FIG. 1 as seen from a protective film side.
Figure 2B:
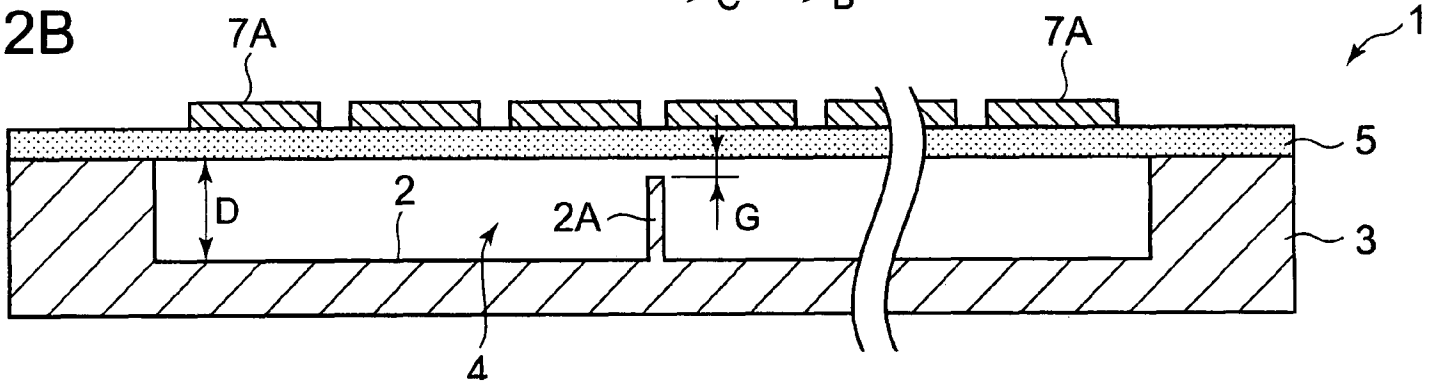
FIG. 2B is a sectional view (lateral sectional view) of the thermal head of FIG. 2A taken along the arrow A-A.
Figure 3:
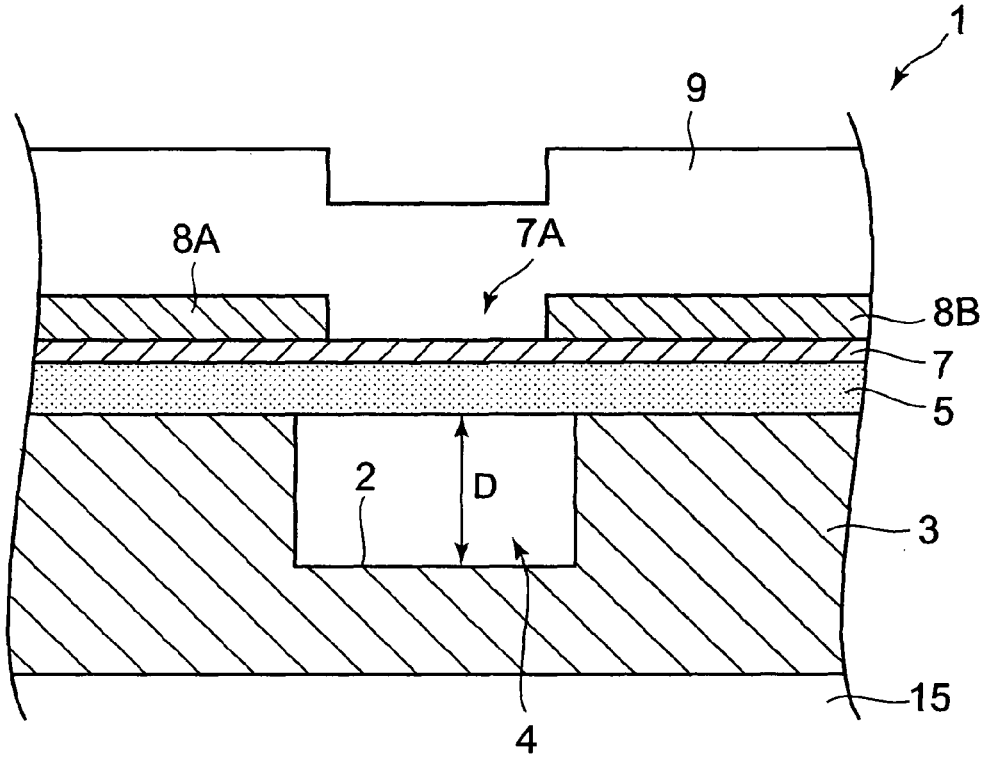
FIG. 3 is a sectional view (vertical sectional view) of the thermal head of FIG. 2A taken along the arrow B-B.

The thermal head 1 has a plate shape as illustrated in FIG. 2A. As illustrated in FIG. 2B and FIG. 3 (which are sectional views taken along the arrow B-B of FIG. 2A), the thermal head 1 includes: a rectangular supporting substrate (substrate) 3 fixed on the heat dissipation plate 15; a heat storage layer 5 bonded onto the surface of the supporting substrate 3; a plurality of heating resistors 7 provided on the heat storage layer 5; electrode portions 8A, 8B connected to the heating resistors 7; and a protective film 9 covering the heating resistors 7 and the electrode portions 8A, 8B so as to protect the same from abrasion and corrosion. Note that, an arrow Y of FIG. 2A indicates a feeding direction of the thermal paper 12 by the paper feeding mechanism 17.

The supporting substrate 3 is an insulating substrate having a thickness of approximately 300 μm to 1 mm, such as a glass substrate and a silicon substrate. On the surface on the heat storage layer 5 side of the supporting substrate 3, there is formed a rectangular concave portion 2 extending in a longitudinal direction. Note that, the depth of the concave portion 2 is denoted by a reference symbol D.

Figure 4:
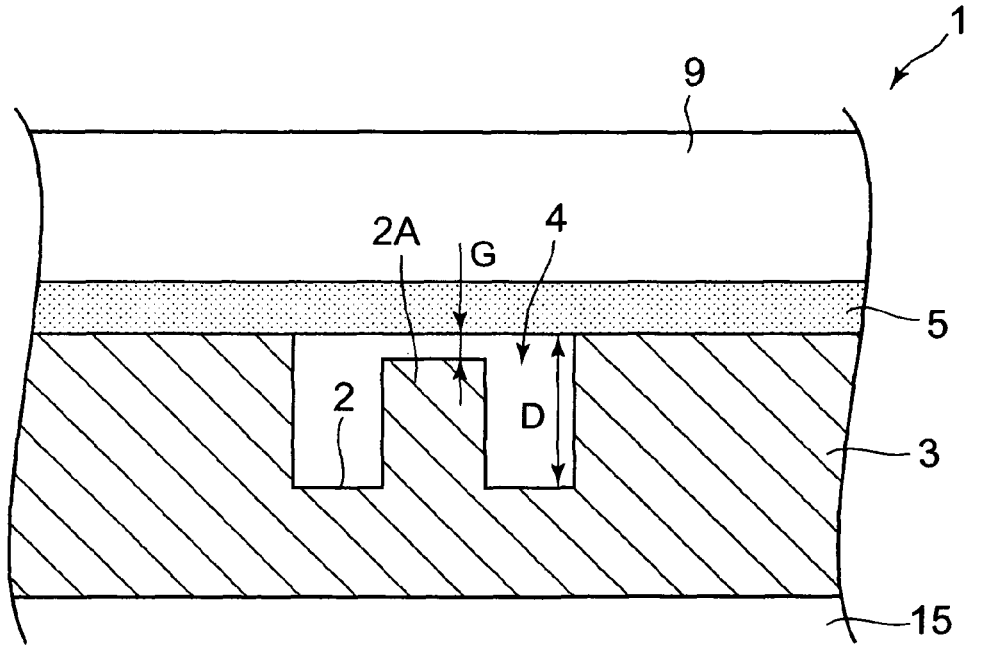
FIG. 4 is a sectional view (vertical sectional view) of the thermal head of FIG. 2A taken along the arrow C-C.

As illustrated in FIG. 4 (which is a sectional view taken along the arrow C-C of FIG. 2A), a protruding portion (limiting portion) 2A having a columnar shape and protruding from substantially the center of the bottom surface of the concave portion 2 toward the opening thereof is provided in the concave portion 2. The forward end of the protruding portion 2A is formed as substantially a flat surface.

The heat storage layer 5 is constituted by a thin plate glass having a thickness of approximately 5 to 50 μm. It is desirable that the heat storage layer 5 have a thickness of approximately 10 μm or less. The heat storage layer 5 and the supporting substrate 3 are bonded to each other by anodic bonding.

Between the supporting substrate 3 and the heat storage layer 5, a hollow portion 4 is formed by covering the concave portion 2 of the supporting substrate 3 with the heat storage layer 5 (Hereinafter, hollow portion is referred to as "hollow heat insulating layer."). The hollow heat insulating layer 4 functions as a heat insulating layer for inhibiting a heat inflow from the heat storage layer 5 to the supporting substrate 3, and has a communicating structure opposed to all the heating resistors 7. By causing the hollow portion to function as the heat insulating layer, it is possible to inhibit the heat generated by the heating resistors 7 from being transmitted through an intermediation of the heat storage layer 5 to the supporting substrate 3. As a result, an amount of heat conducted above the heating resistors 7 to be used for printing and the like is increased, whereby improvement in heating efficiency is achieved.

Figure 5:
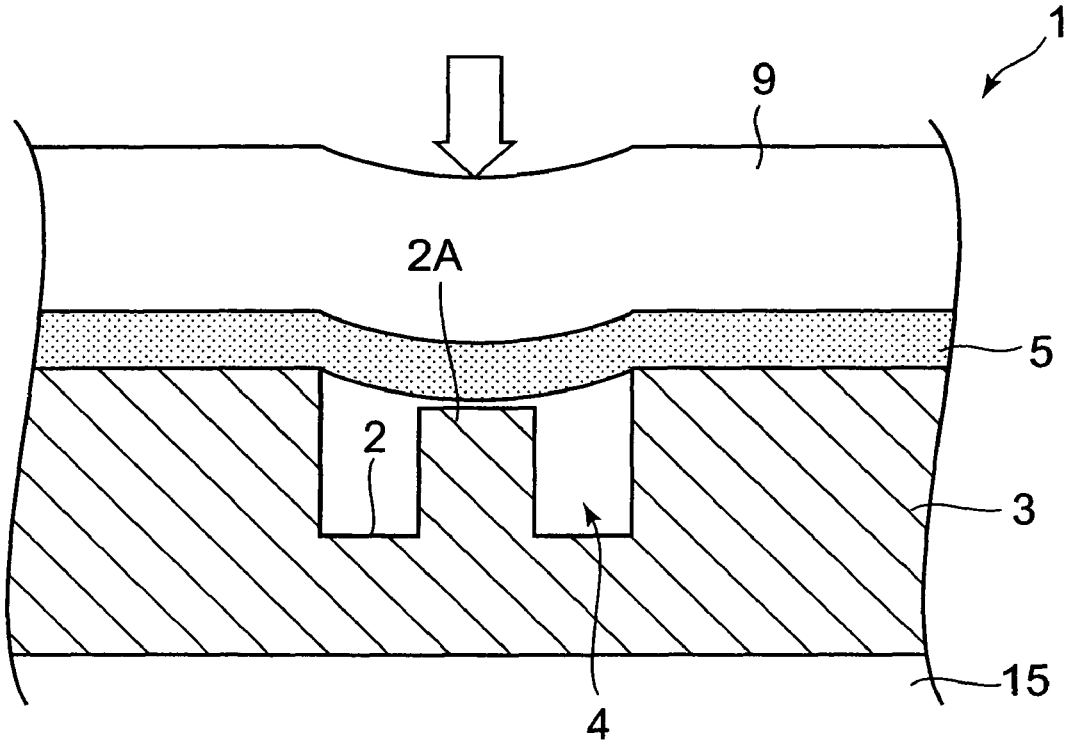
FIG. 5 is a sectional view illustrating a state in which load is applied to the thermal head of FIG. 4.

Inside the hollow heat insulating layer 4, a gap G is provided between the forward end of the protruding portion 2A and the heat storage layer 5. The gap G has a size enough to allow the heat storage layer 5 to come into contact with the forward end of the protruding portion 2A within a range in which the heat storage layer 5 is elastically deformed, and it is desirable that the gap have the size of, for example, approximately 0.1 μm or more and 1 μm or less. With this structure, as illustrated in FIG. 5, when the heating resistors 7 are pressurized with predetermined load or more by the pressing force of the platen roller 13 and the like, the heat storage layer 5 comes into contact with the protruding portion 2A and is supported by the same without being involved with breakage.

The heating resistors 7 are each provided so as to straddle the concave portion 2 in its width direction on an upper end surface of the heat storage layer 5, and are arranged at predetermined intervals in the longitudinal direction of the concave portion 2. In other words, each of the heating resistors 7 is provided to be opposed to the hollow heat insulating layer 4 through an intermediation of the heat storage layer 5 so as to be situated above the hollow heat insulating layer 4.

The electrode portions 8A, 8B serve to heat the heating resistors 7, and are constituted by a common electrode 8A connected to one end of each of the heating resistors 7 in a direction orthogonal to the arrangement direction of the heating resistors 7, and individual electrodes 8B connected to the other end of each of the heating resistors 7. The common electrode 8A is integrally connected to all the heating resistors 7.

When voltage is selectively applied to the individual electrodes 8B, current flows through the heating resistors 7 connected to the selected individual electrodes 8B and the common electrode 8A opposed thereto, whereby the heating resistors 7 are heated. In this state, the thermal paper 12 is pressed by the operation of the pressure mechanism 19 against the surface portion (printing portion) of the protective film 9 covering the heating portions of the heating resistors 7, whereby color is developed on the thermal paper 12 and printing is performed.

Note that, of each of the heating resistors 7, an actually heating portion (hereinafter, referred to as "heating portion 7A") is a portion of each of the heating resistors 7 on which the electrode portions 8A, 8B do not overlap, that is, a portion of each of the heating resistors 7 which is a region between the connecting surface of the common electrode 8A and the connecting surface of each of the individual electrodes 8B and is situated substantially directly above the hollow heat insulating layer 4.

Hereinafter, a manufacturing method A of the thermal head 1 constructed as described above (hereinafter, simply referred to as "manufacturing method A") is described.

Figure 6A:
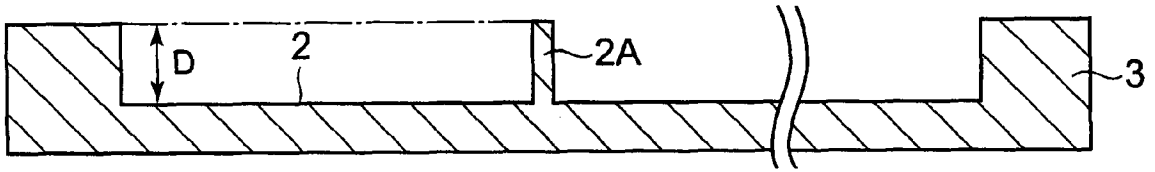
FIG. 6A is a vertical sectional view illustrating a concave portion forming step in a manufacturing method A according to the first embodiment of the present invention.

First, as illustrated in FIG. 6A, on the surface of the supporting substrate 3, the concave portion 2 and the protruding portion 2A protruding from the bottom surface of the concave portion 2 toward the opening thereof are formed so as to be opposed to a region in which the heating resistors 7 are formed.

The concave portion 2 is formed by performing, for example, sandblasting, dry etching, wet etching, or laser machining on one surface of the supporting substrate 3.

When the sandblasting is performed on the supporting substrate 3, the one surface of the supporting substrate 3 is covered with a photoresist material, and the photoresist material is exposed to light using a photomask of a predetermined pattern, whereby there is cured a portion other than the region in which the concave portion 2 is formed.

After that, by cleaning the one surface of the supporting substrate 3 and removing the photoresist material which is not cured, etching masks (not shown) having etching windows formed in the region in which the concave portion 2 is formed can be obtained. In this state, the sandblasting is performed on the one surface of the supporting substrate 3, and the concave portion 2 having the depth D is formed (concave portion forming step). It is desirable that the depth D of the concave portion 2 be, for example, 10 μm or more and half or less of the thickness of the supporting substrate 3.

Further, when etching, such as the dry etching and the wet etching, is performed, as in the case of the sandblasting, the etching masks having the etching windows formed in the region in which the concave portion 2 is formed are formed on the surface of the supporting substrate 3. In this state, by performing the etching on the one surface of the supporting substrate 3, the concave portion 2 having the depth D is formed.

As such an etching process, there are used the wet etching using hydrofluoric acid-based etchant or the like, and the dry etching such as reactive ion etching (RIE) and plasma etching. Note that, as a reference example, in the case of a single-crystal silicon substrate, there is performed the wet etching using the etchant such as tetramethylammonium hydroxide solution, KOH solution, and mixing solution of hydrofluoric acid and nitric acid.

Figure 6B:
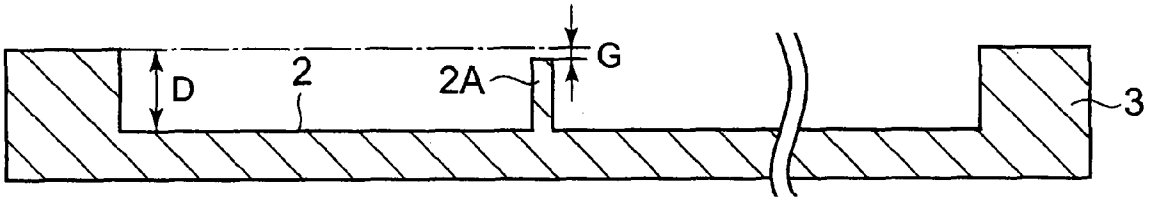
FIG. 6B is a vertical sectional view illustrating a gap forming step in the manufacturing method A.

Next, as illustrated in FIG. 6B, after all the etching masks are removed from the one surface of the supporting substrate 3, the height of the protruding portion 2A is reduced (gap forming step). An example of the processing method therefor includes polishing.

Figure 6C:
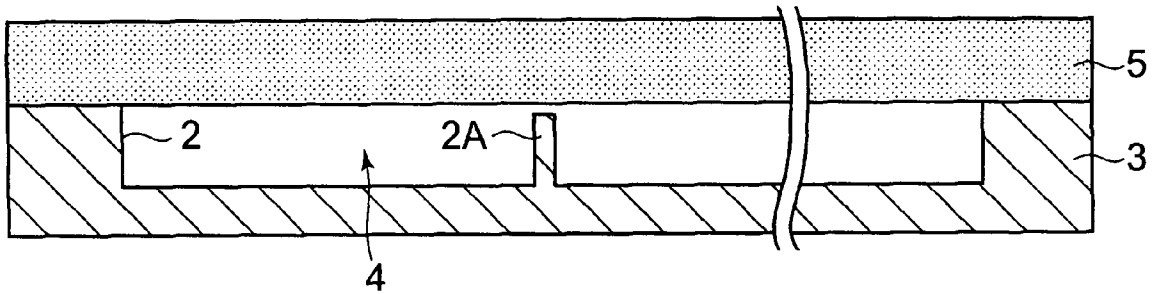
FIG. 6C is a vertical sectional view illustrating a bonding step in the manufacturing method A.

Subsequently, as illustrated in FIG. 6C, the thin plate glass having the thickness of 5 μm to 100 μm is bonded onto the one surface of the supporting substrate 3 in which the concave portion 2 is formed in the concave portion forming step, and the heat storage layer 5 is formed (bonding step). The supporting substrate 3 and the thin plate glass are adhered to each other by an adhesive. Note that, without using the adhesive, the supporting substrate 3 and the thin plate glass may be directly bonded to each other by thermal fusion.

The surface of the supporting substrate 3 is covered with the heat storage layer 5, in other words, the opening of the concave portion 2 is covered with the thin plate glass, whereby the hollow portion (hollow heat insulating layer) 4 is formed between the supporting substrate 3 and the heat storage layer 5. The thickness of the hollow portion is determined based on the depth D of the concave portion 2, and hence it is possible to easily control the thickness of the hollow heat insulating layer 4.

Further, inside the hollow heat insulating layer 4, the gap G is formed between the protruding portion 2A and the heat storage layer 5.

Figure 6D:
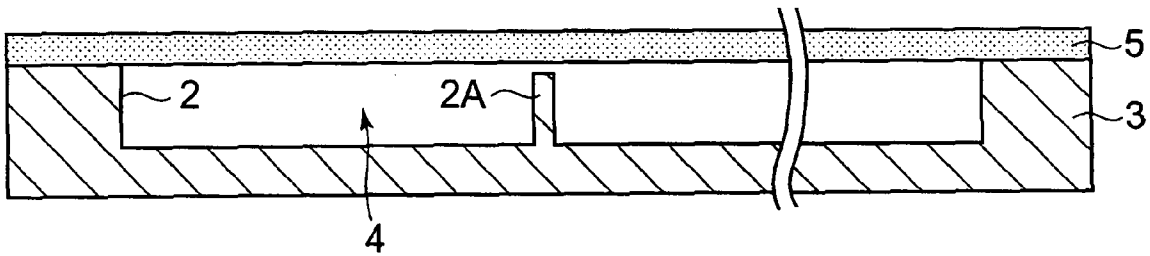
FIG. 6D is a vertical sectional view illustrating a thinning step in the manufacturing method A.

Here, it is difficult to manufacture and handle a thin plate glass having a thickness of 100 μm or less, and such a thin plate glass is expensive. Thus, instead of bonding an originally thin plate glass directly onto the supporting substrate 3, the thin plate glass having the thickness allowing easy manufacture and handling thereof may be bonded onto the supporting substrate 3 (see FIG. 6C), and then, as illustrated in FIG. 6D, the thin plate glass may be additionally processed by the etching, the polishing, or the like so that the thin plate glass has a desired thickness (thinning step). With this process, it is possible to easily form the extremely thin heat storage layer 5 over the one surface of the supporting substrate 3 at low cost.

Note that, as the etching of the thin plate glass, there can be used various types of etching adopted for forming the concave portion 2 as described above. Further, as the polishing of the thin plate glass, for example, there can be used chemical mechanical polishing (CMP) which is used for high-accuracy polishing of a semiconductor wafer and the like.

Figure 7A:
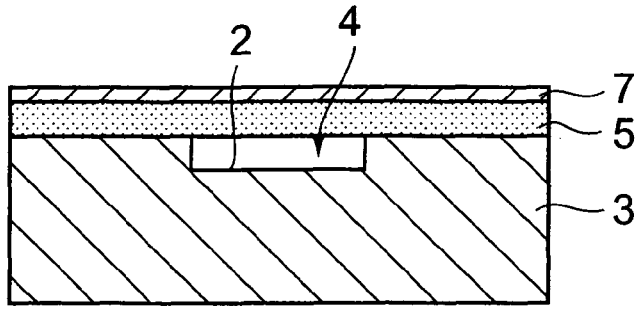
FIG. 7A is a vertical sectional view illustrating a heating resistor forming step in the manufacturing method A according to the first embodiment of the present invention.
Figure 7B:
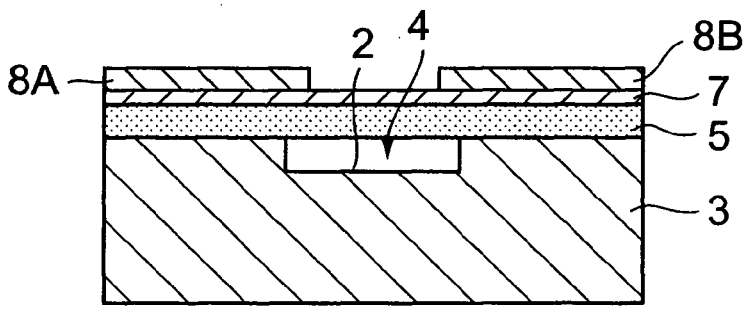
FIG. 7B is a vertical sectional view illustrating a step of forming electrode portions in the manufacturing method A.
Figure 7C:
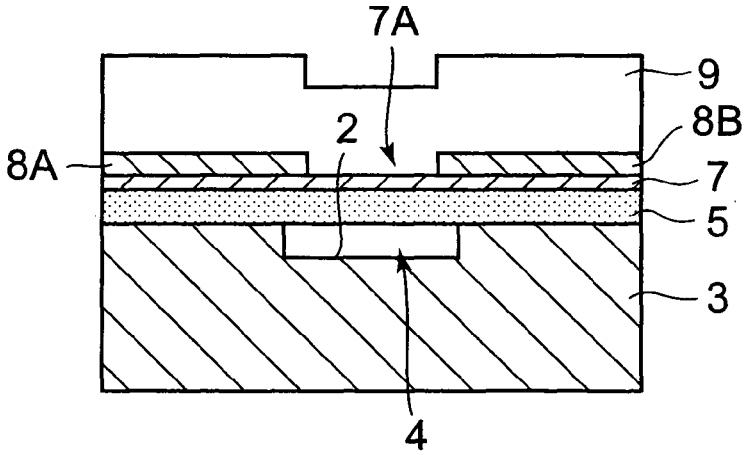
FIG. 7C is a vertical sectional view illustrating a step of forming a protective film in the manufacturing method A.

Next, as illustrated in FIGS. 7A to 7C, the heating resistors 7, the common electrode 8A, the individual electrodes 8B, and the protective film 9 are subsequently formed on the heat storage layer 5 (heating resistor forming step and the like). The heating resistors 7, the common electrode 8A, the individual electrodes 8B, and the protective film 9 can be manufactured by using a well-known manufacturing method for a conventional thermal head.

Specifically, in the heating resistor forming step, a thin film formation method such as sputtering, chemical vapor deposition (CVD), or vapor deposition is used to form a thin film made of a Ta-based or silicide-based heating resistor material on the heat storage layer 5. Then, the thin film made of the heating resistor material is molded by lift-off, etching, or the like, whereby the heating resistor 7 having a desired shape is formed.

Subsequently, as in the heating resistor forming step, the film formation with use of a wiring material such as Al, Al—Si, Au, Ag, Cu, and Pt is performed on the heat storage layer 5 by using sputtering, vapor deposition, or the like. Then, the film thus obtained is formed by lift-off or etching, or the wiring material is screen-printed and is, for example, burned thereafter, to thereby form the common electrode 8A and the individual electrodes 8B which have the desired shape. Note that, the heating resistors 7, the common electrode 8A, and the individual electrodes 8B are formed in an appropriate order.

In the lift-off for the heating resistors 7 and the electrode portions 8A, 8B or in the patterning of a resist material for the etching, the patterning is performed on the photoresist material by using a photomask.

After the formation of the heating resistors 7, the common electrodes 8A, and the individual electrodes 8B, the film formation with use of a protective film material such as $SiO_2$, $Ta_2O_5$, SiAlON, $Si_3N_4$, or diamond-like carbon is performed on the heat storage layer 5 by sputtering, ion plating, CVD, or the like, whereby the protective film 9 is formed. Thus, the individual thermal head 1 illustrated in FIG. 1 is manufactured.

Next, there is described a relation between load of the platen roller 13, which is applied to the thermal head 1 of the thermal printer 10 according to this embodiment, and strength of the heat storage layer 5 with respect to external load.

With respect to the surface of the protective film 9 (which is not shown, and hereinafter, referred to as "head surface"), which comes into contact with the thermal paper 12 and is situated above the heating resistors 7, surface load is applied substantially uniformly by the pressing force of the platen roller 13. By this surface load, deflection occurs in the heat storage layer 5 above the hollow heat insulating layer 4. The deflection amount (sinking shift) of the heat storage layer 5 becomes maximum at substantially the center of the hollow heat insulating layer 4 as seen from the protective film 9 side.

Further, point load due to micro particles is applied to the above-mentioned head surface in some cases. When the point load is concentrated at one point near the center of the hollow heat insulating layer 4, a degree of deflection of the heat storage layer 5 is further increased, and tensile stress of the surface of the heat storage layer 5 at this point is extremely increased.

In a normal printing state, the load applied from the platen roller 13 to the head surface is the surface load, and the deflection amount of the heat storage layer 5 which supports the heating resistors 7 is relatively small. Therefore, even when some degree of deflection occurs in the heat storage layer 5, owing to provision of the gap G, the heat storage layer 5 and the protruding portion 2A do not come into contact with each other, and hence the thermal head 1 can maintain high heat insulating performance.

However, in the case where large load, in particular, the point load is applied to the head surface, relatively large deflection occurs in the heat storage layer 5. In this case, the heat storage layer 5 comes into contact with the protruding portion 2A within its elastic deformation range. With this, in order to prevent the heat storage layer 5 from being deformed beyond the elastic deformation range, that is, in order to prevent the tensile stress from exceeding breaking stress of the glass, the deflection of the heat storage layer 5 is limited, and hence it is possible to prevent the heat storage layer 5 from breaking.

As described above, in the printer 10 and the thermal head 1 according to this embodiment, by the protruding portion 2A limiting the deflection of the heat storage layer 5, the strength of the heat storage layer 5 with respect to the external load is increased, whereby the thickness of the heat storage layer 5 can be thinned and heating efficiency can be improved. In addition, the gap G between the protruding portion 2A and the heat storage layer 5 is set to 1 μm or less, whereby it is possible to particularly increase the strength of the heat storage layer 5 with respect to the external load. Therefore, sufficient strength can be obtained even when the heat storage layer 5 has the thickness of 10 μm or less. Thus, it is possible to improve the heating efficiency and the strength with respect to the external load.

Further, by forming the protruding portion 2A into a columnar shape, a contact area when the heat storage layer 5 and the protruding portion 2A come into contact with each other becomes relatively small, and hence it is possible to suppress a decrease in heating efficiency.

Further, the thermal head 1 has high heating efficiency, and hence it is possible to reduce power consumption at the time of performing printing on the thermal paper 12. Further, the head surface does not has an extremely concave shape, and hence good abutting state between the thermal paper 12 and the head surface can be achieved. Therefore, it is possible to perform printing with low power and excellent printing quality.

Note that, this embodiment can be modified as follows.

Figure 8A:
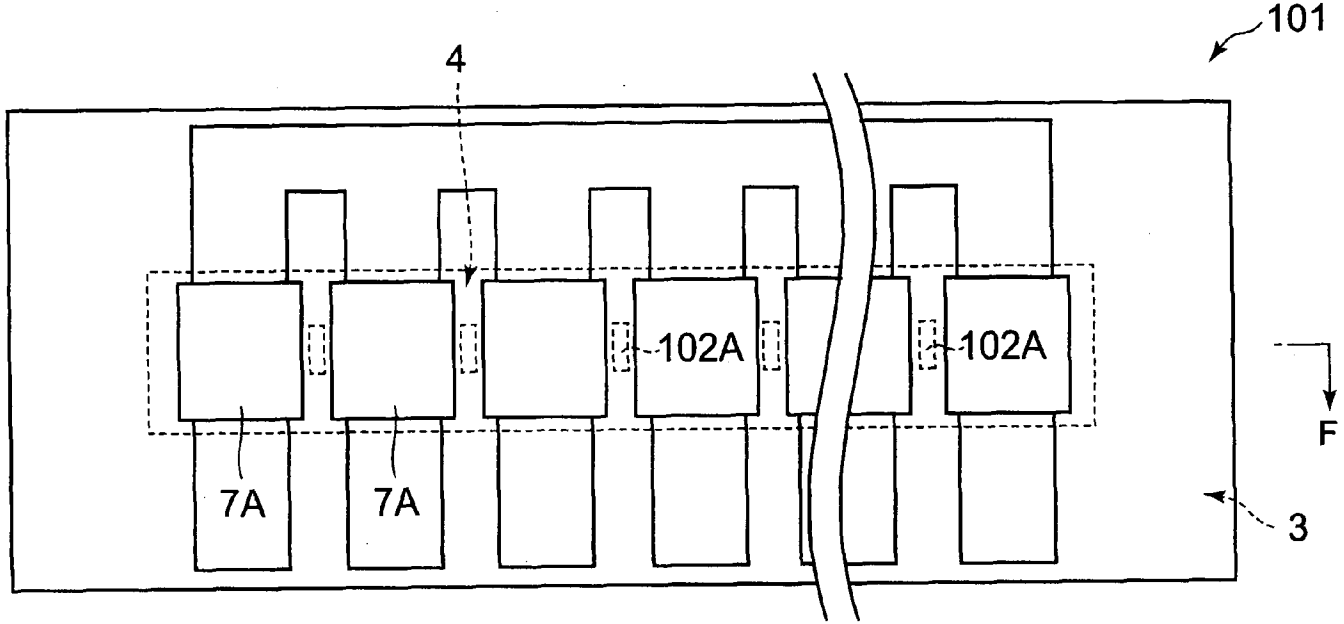
FIG. 8A is a plane view of a thermal head according to a first modification of the first embodiment of the present invention as seen from the protective film side.
Figure 8B:
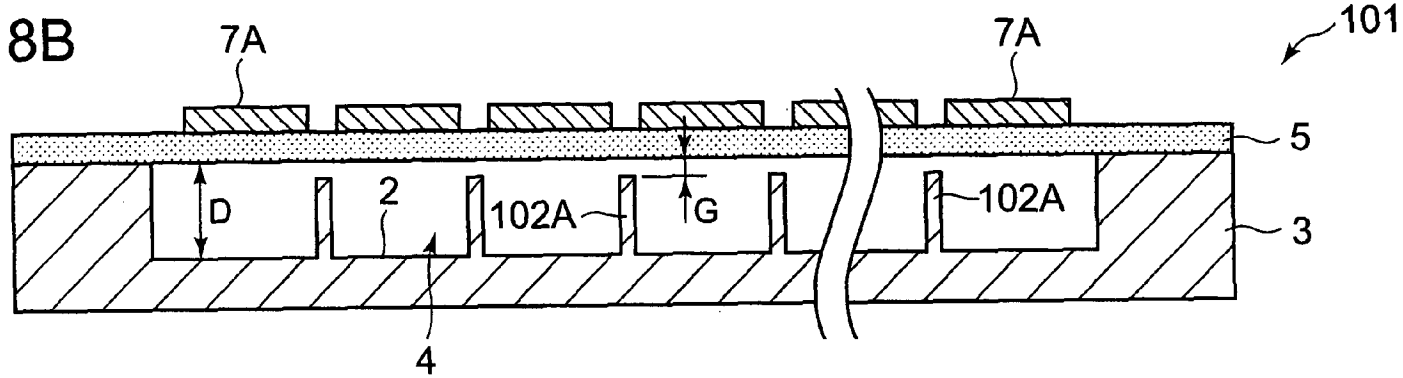
FIG. 8B is a sectional view of the thermal head of FIG. 8A taken along the arrow F-F.
Figure 9A:
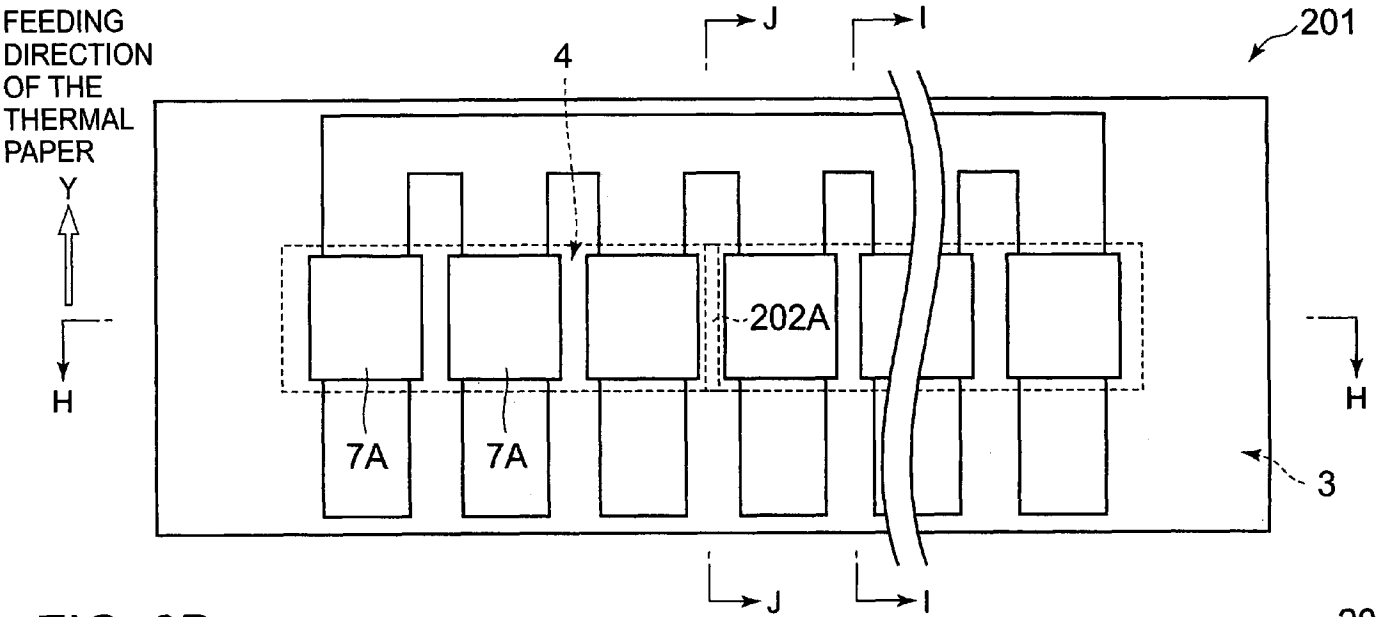
FIG. 9A is a plane view of a thermal head according to a second modification of the first embodiment of the present invention as seen from the protective film side.
Figure 9B:
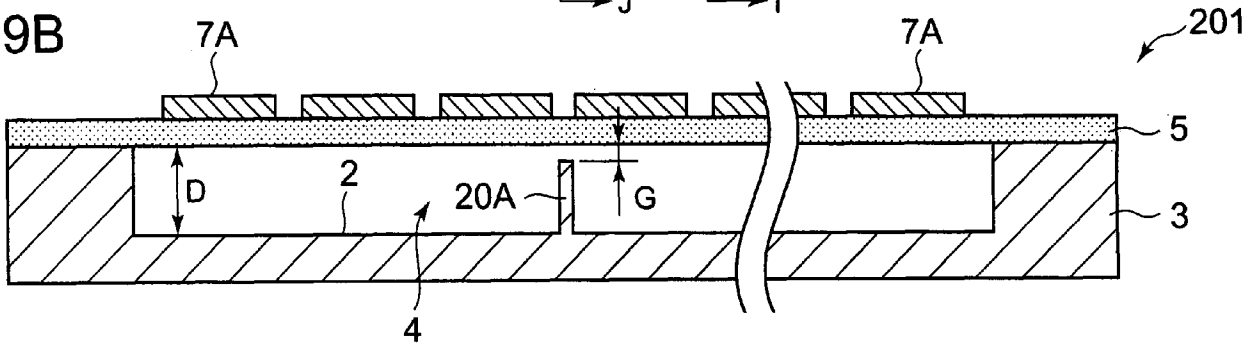
FIG. 9B is a sectional view of the thermal head of FIG. 9A taken along the arrow H-H.
Figure 10:
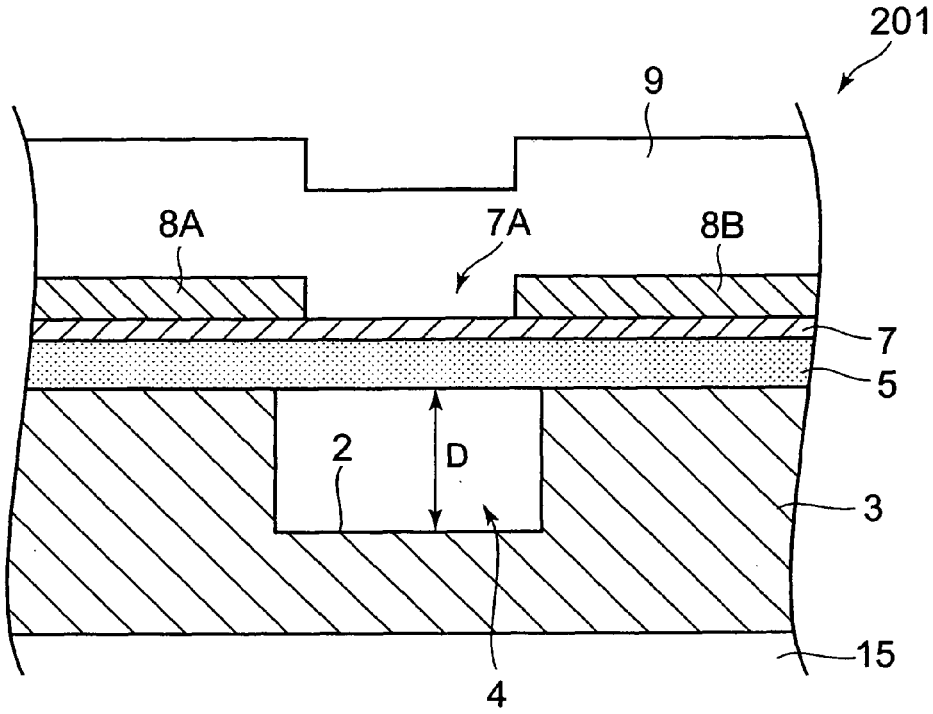
FIG. 10 is a sectional view of the thermal head of FIG. 9A taken along the arrow I-I.
Figure 11:
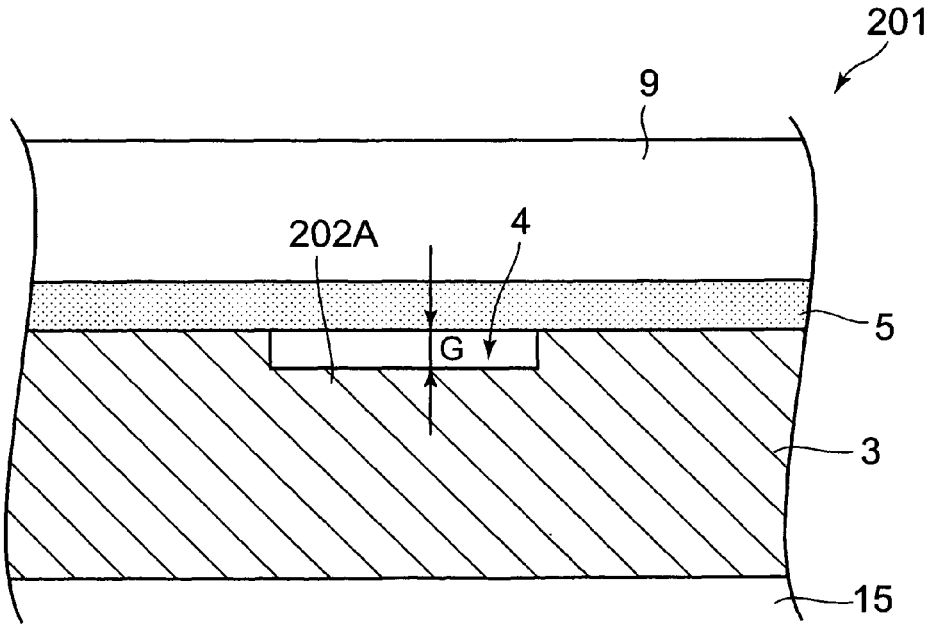
FIG. 11 is a sectional view of the thermal head of FIG. 9A taken along the arrow J-J.
Figure 12A:
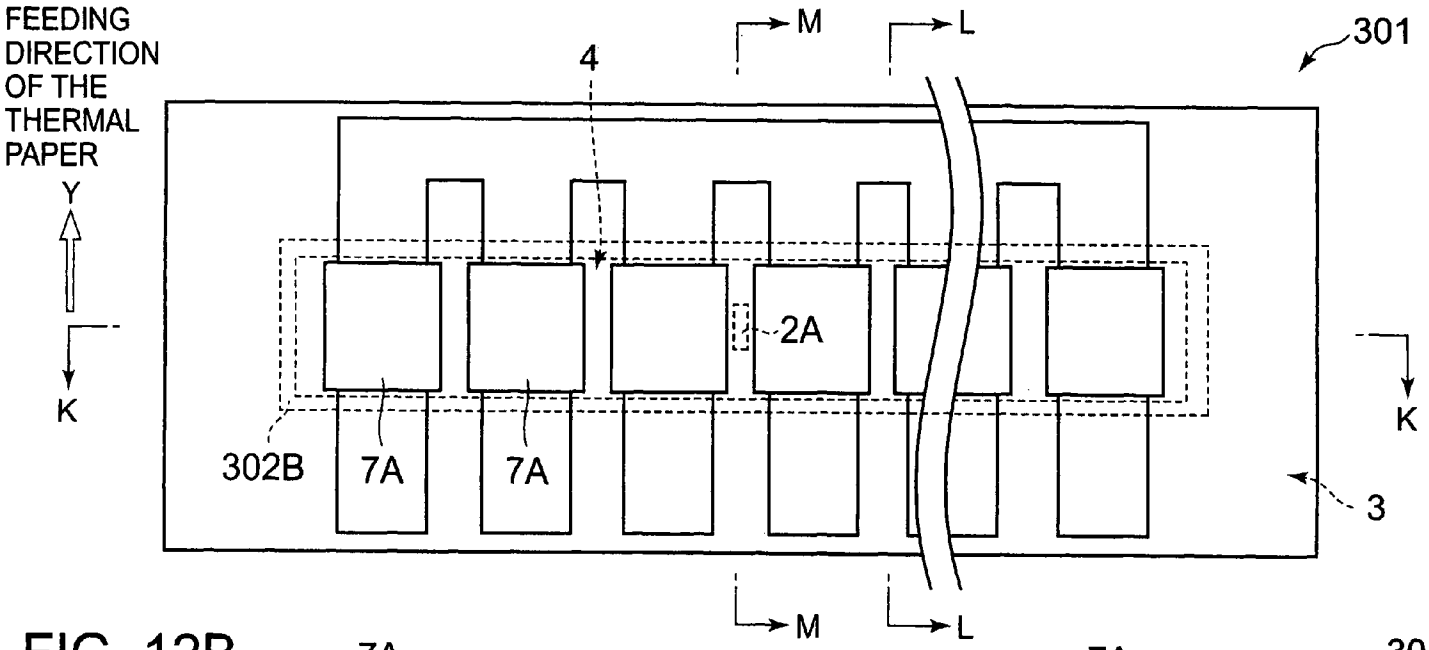
FIG. 12A is a plane view of a thermal head according to a second embodiment of the present invention as seen from the protective film side.
Figure 12B:
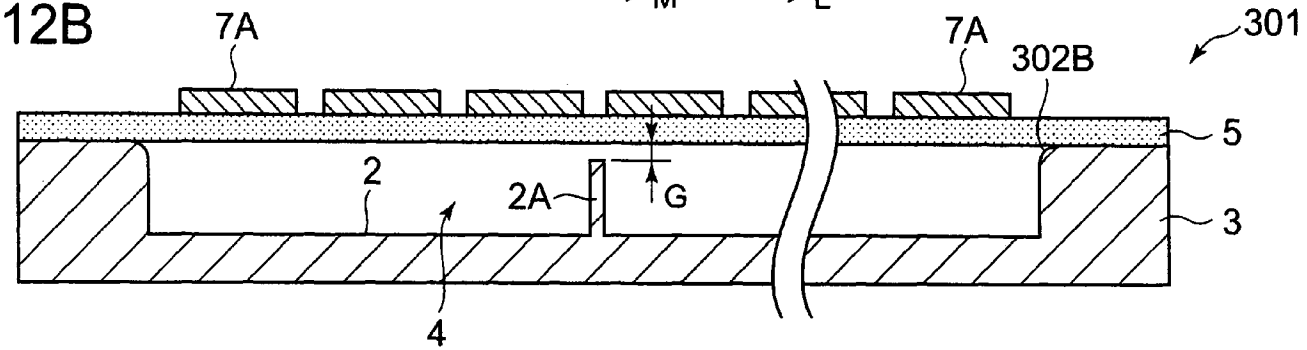
FIG. 12B is a sectional view of the thermal head of FIG. 12A taken along the arrow K-K.
Figure 13:
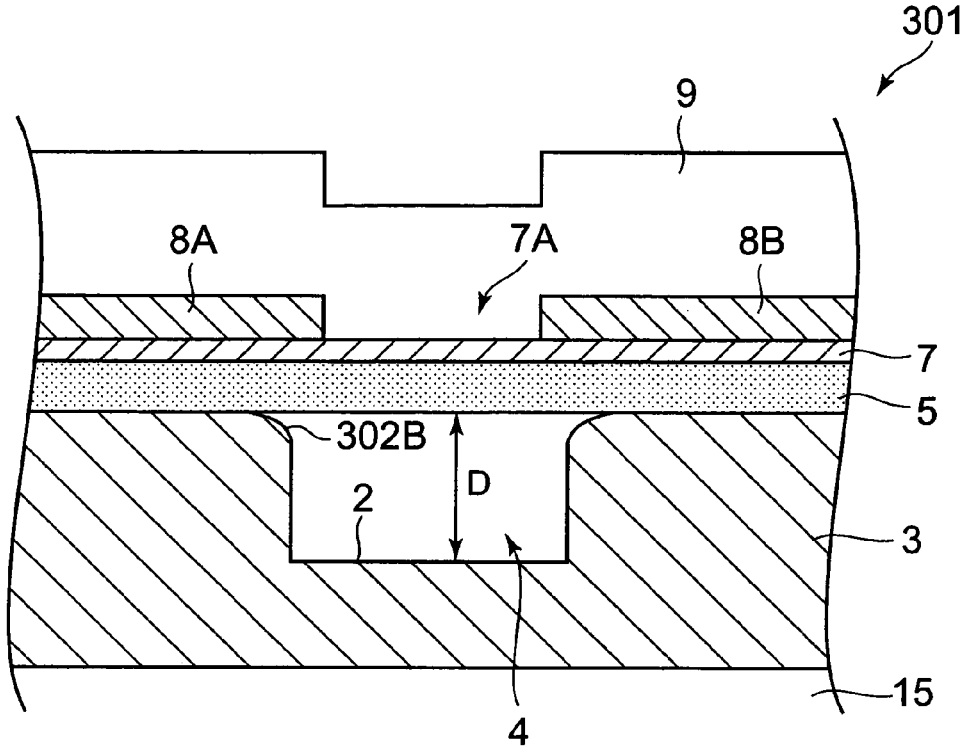
FIG. 13 is a sectional view of the thermal head of FIG. 12A taken along the arrow L-L.
Figure 14:
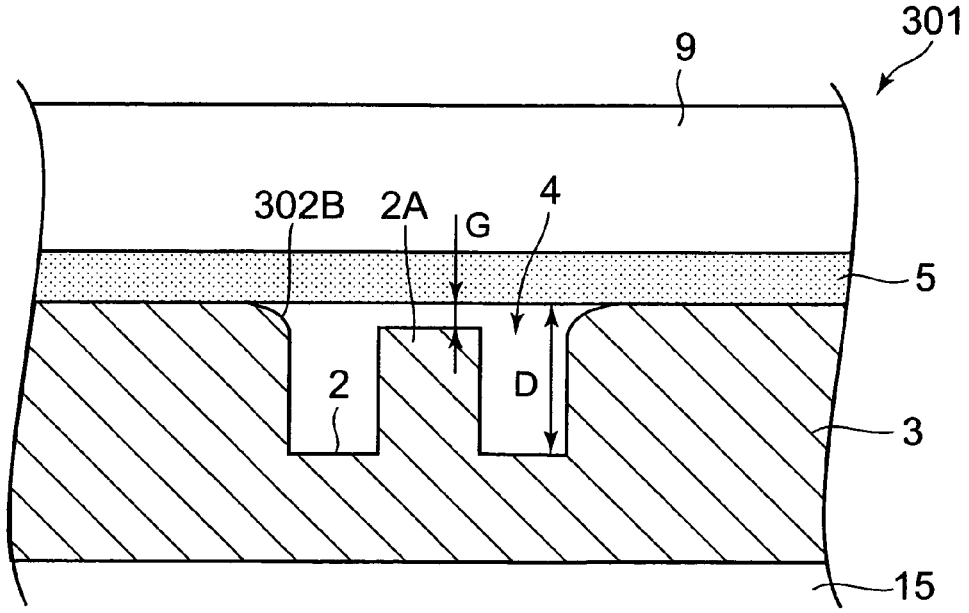
FIG. 14 is a sectional view of the thermal head of FIG. 12A taken along the arrow M-M.

For example, in this embodiment, the single protruding portion 2A having a columnar shape is provided inside the hollow heat insulating layer 4. However, as illustrated in FIGS. 8A and 8B, in a thermal head 101 according to a first modification, a plurality of protruding portions 102A may be arranged between the heating portions 7A.

The deflection of the heat storage layer 5 is limited by the plurality of protruding portions 102A arranged in a wide range, whereby it is possible to improve the strength of the heat storage layer 5 with respect to the external load. Further, by arranging the protruding portions 102A between the heating portions 7A, in comparison with the case of arranging the same irregularly, it is possible to realize uniformity of heating efficiency of the heating portions 7A and uniformity of heat insulating performance of the hollow heat insulating layer 4.

Further, as illustrated in FIGS. 9A to 11, a thermal head 201 according to a second modification may include a protruding portion 202A having a wall-like shape and protruding from the bottom surface of the concave portion 2 toward the opening thereof so as to divide the concave portion 2 at substantially the midpoint in the longitudinal direction. With this structure, in comparison with the protruding portion 2A having a columnar shape, the contact area between the protruding portion 202A and the heat storage layer 5 is increased, and it is possible to limit the deflection of the heat storage layer 5 more stably. Note that, the protruding portion 202A may be formed so as to block the hollow heat insulating layer 4 except for the gap G between the heat storage layer 5 and the protruding portion 202A in a width direction.

Second Embodiment

Hereinafter, a thermal head 301 according to a second embodiment of the present invention is described with reference to the drawings.

As illustrated in FIGS. 12A to 14, the thermal head 301 according to this embodiment is different from the thermal head according to the first embodiment in that a peripheral edge of the concave portion 2 (hereinafter, referred to as "peripheral edge portion 302B") in the surface of the supporting substrate 3 is chamfered to have a gently curved shape.

Hereinafter, in the description of this embodiment, portions having the common structures with those of the thermal head 1 according to the first embodiment are denoted by the same reference symbols, and description thereof is omitted.

Figure 15:
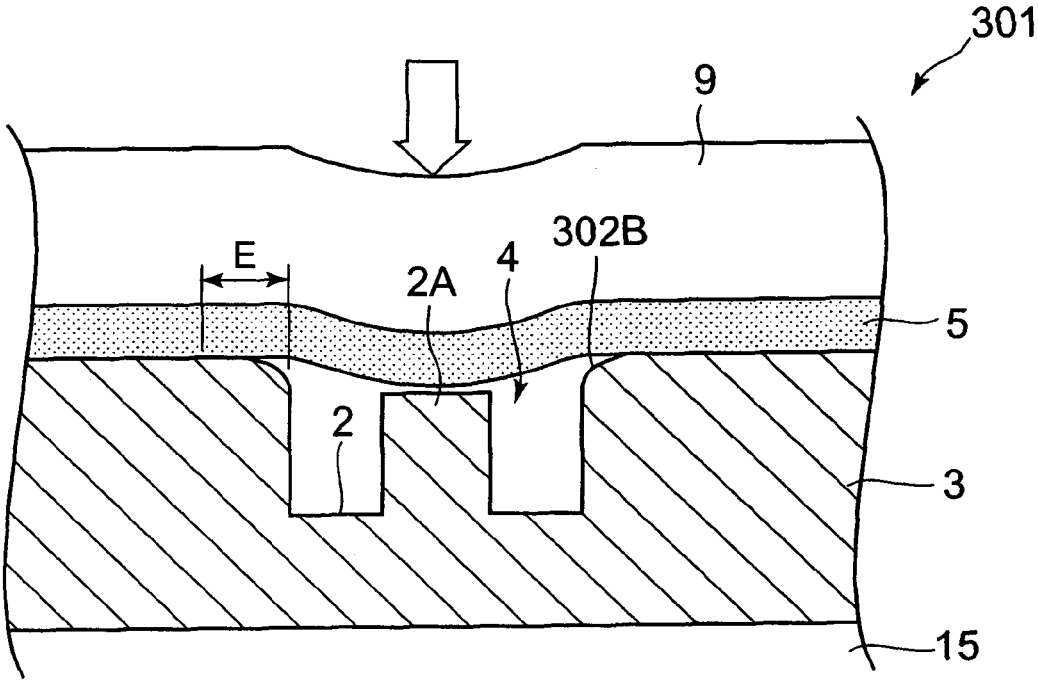
FIG. 15 is a sectional view illustrating a state in which load is applied to the thermal head of FIG. 14.

The peripheral edge portion 302B of the concave portion 2 is formed as a curved surface which is curved from the surface of the supporting substrate 3 toward the inside of the concave portion 2 in a direction of being gradually apart from the heat storage layer 5. For example, as illustrated in FIG. 15, in a state in which the deflection occurs in the heat storage layer 5 and the heat storage layer 5 comes into contact with the protruding portion 2A, a slight gap is formed between the heat storage layer 5 and the peripheral edge portion 302B.

Hereinafter, a manufacturing method B for the thermal head 301 constructed as described above (hereinafter, simply referred to as "manufacturing method B") is described with reference to FIGS. 16A to 16D.

Figures 16A, 16B, 16C, 16D:
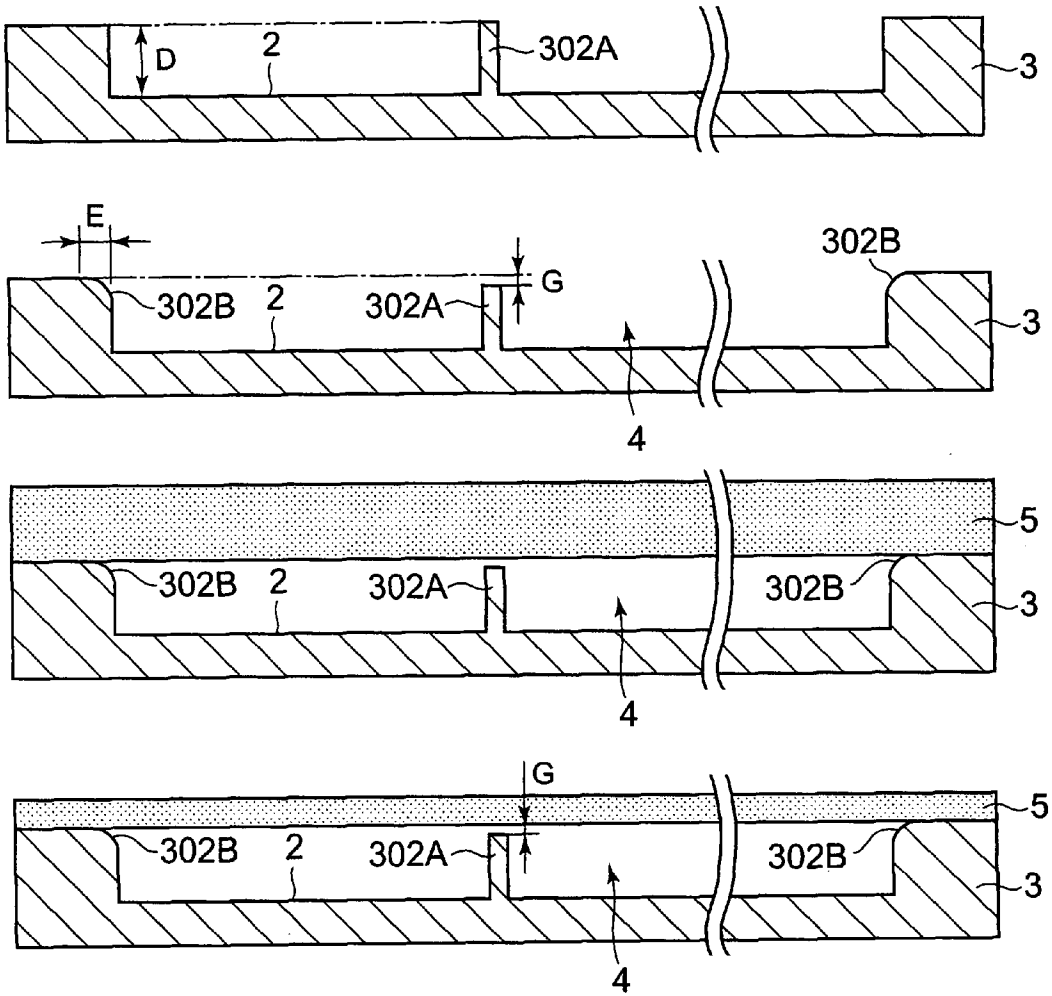
FIG. 16A is a vertical sectional view illustrating a concave portion forming step in a manufacturing method B according to the second embodiment of the present invention.
FIG. 16B is a vertical sectional view illustrating a gap forming step in the manufacturing method B.
FIG. 16C is a vertical sectional view illustrating a bonding step in the manufacturing method B.
FIG. 16D is a vertical sectional view illustrating a thinning step in the manufacturing method B.

After the concave portion forming step (see FIG. 16A), as illustrated in FIG. 16B, a height of a protruding portion 302A is decreased in the gap forming step, and the peripheral edge of the concave portion 2 is chamfered, whereby the peripheral edge portion 302B is formed as the gently curved surface (peripheral edge portion forming step). As a curved surface forming method, burnishing, wet etching, or the like can be used. Note that, the concave portion forming step, the bonding step, and the thinning step are the same as those in the manufacturing method A, and hence description thereof is omitted.

Further, a width E and a curvature radius R of the peripheral edge portion 302B may be set such that the heat storage layer 5 is prevented from completely coming into surface contact with the peripheral edge portion 302B in the case where the deflection occurs in the heat storage layer 5 due to the external load and the heat storage layer 5 comes into contact with the protruding portion 2A. For example, it is desirable that the width E of the peripheral edge portion 302B be set to approximately 1 to 10 μm when being measured from the original edge of the concave portion 2, and that the curvature radius R be set to satisfy R≧E.

As described above, in the thermal head 301 according to this embodiment, in the case where the external load is applied to the heat storage layer 5 and the deflection occurs, it is possible to alleviate concentration of stress applied to the heat storage layer 5 near the peripheral edge portion 302B of the concave portion 2. With this, it is possible to increase the strength of the heat storage layer 5 with respect to the external load, and possible to effectively prevent breakage of the heat storage layer 5. Note that, the shape of the peripheral edge portion 302B is not limited to an inclined surface having a curvature, and may be a flat inclined surface.

Next, a manufacturing method C for the thermal heads 1, 101, 201, and 301, which is different from the manufacturing method A and the manufacturing method B, is described with reference to FIGS. 17A to 17D.

The manufacturing method C is different from the manufacturing methods A and B in that a temporary bonding step and a main bonding step (bonding step) are provided instead of the gap forming step and the bonding step as described above. Hereinafter, regarding common steps with those in the manufacturing methods A and B, detailed description is omitted.

Figures 17A, 17B, 17C, 17D:
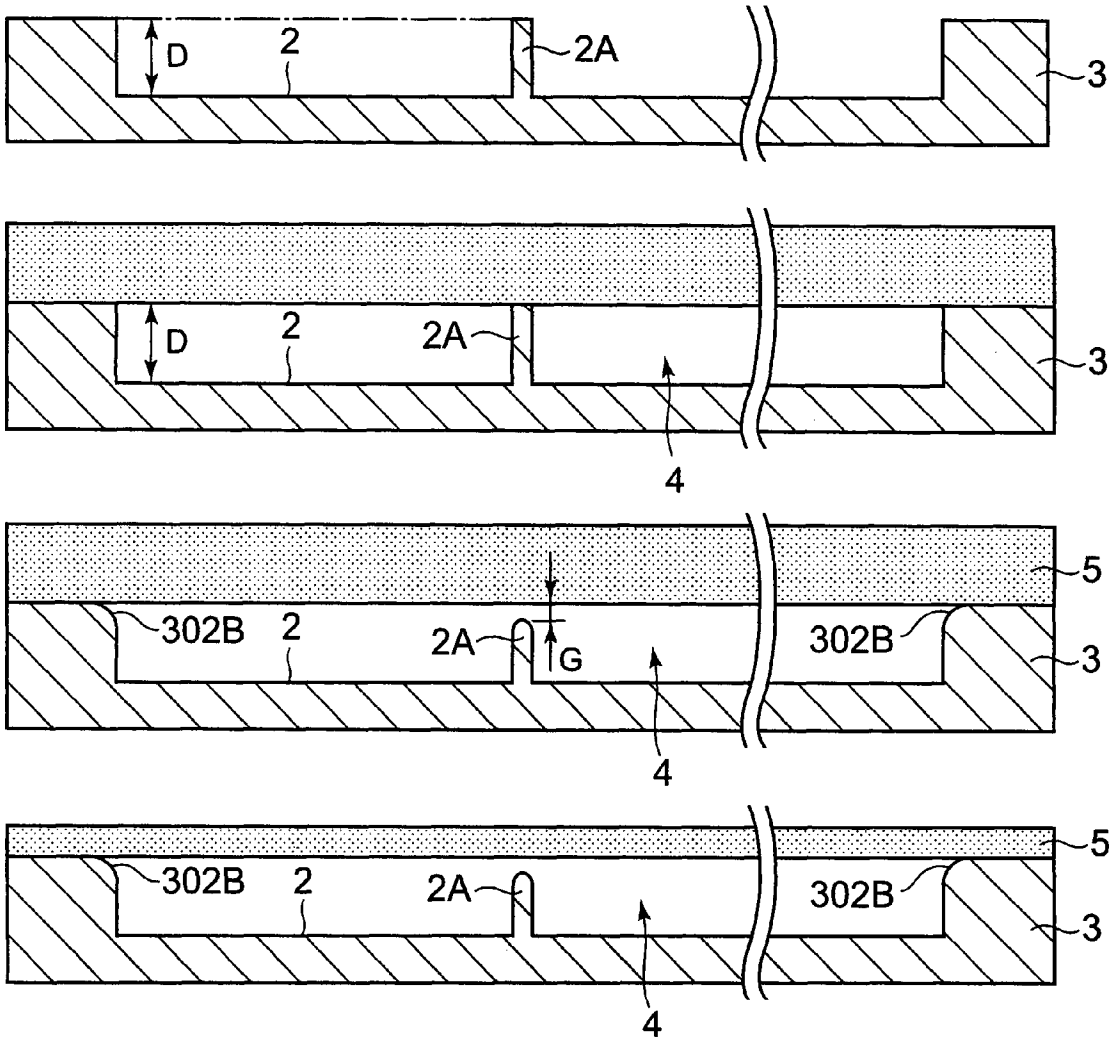
FIG. 17A is a vertical sectional view illustrating a concave portion forming step in a manufacturing method C.
FIG. 17B is a vertical sectional view illustrating a gap forming step in the manufacturing method C.
FIG. 17C is a vertical sectional view illustrating a bonding step in the manufacturing method C.
FIG. 17D is a vertical sectional view illustrating a thinning step in the manufacturing method C.
Figure 18A:
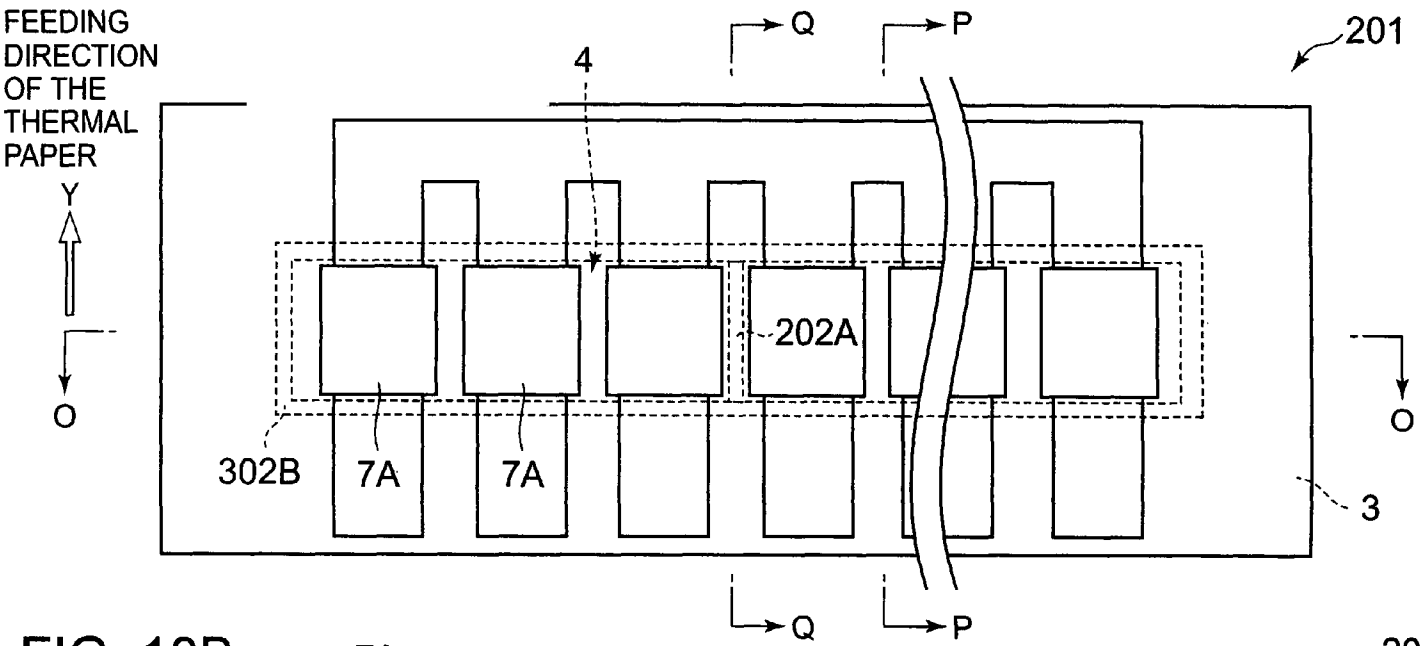
FIG. 18A is a plane view of a thermal head, which is manufactured with the manufacturing method C, according to a third modification as seen from the protective film side.
Figure 18B:
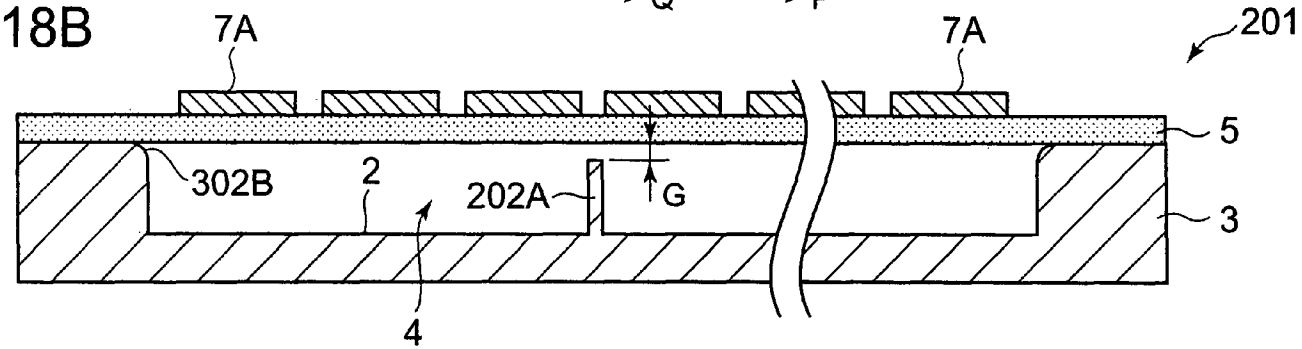
FIG. 18B is a sectional view of the thermal head of FIG. 18A taken along the arrow O-O.
Figure 19:
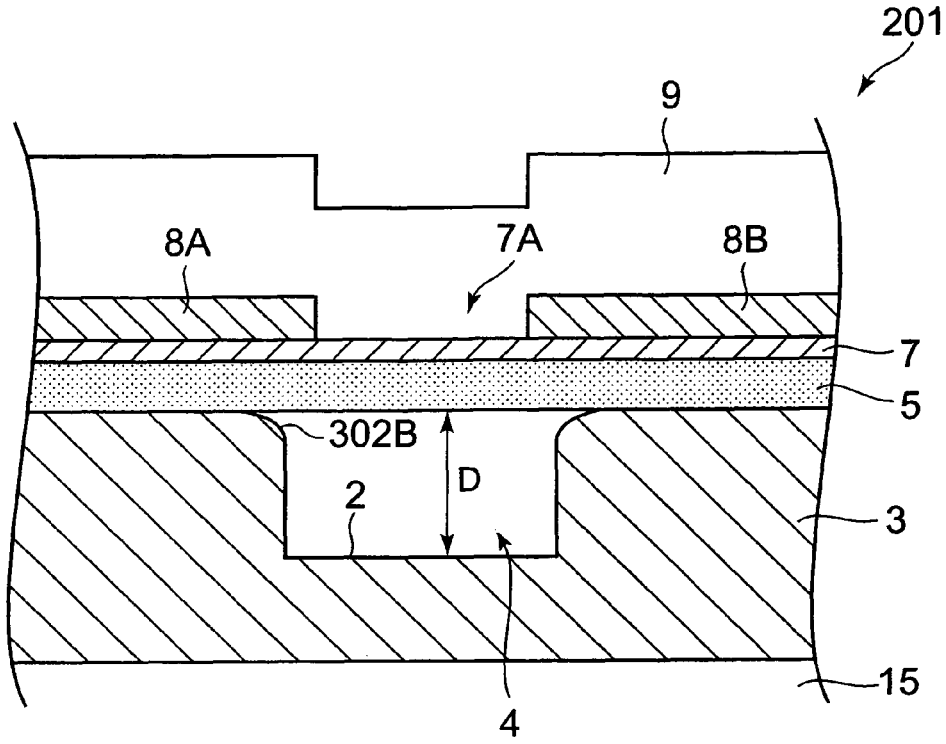
FIG. 19 is a sectional view of the thermal head of FIG. 18A taken along the arrow P-P.
Figure 20:
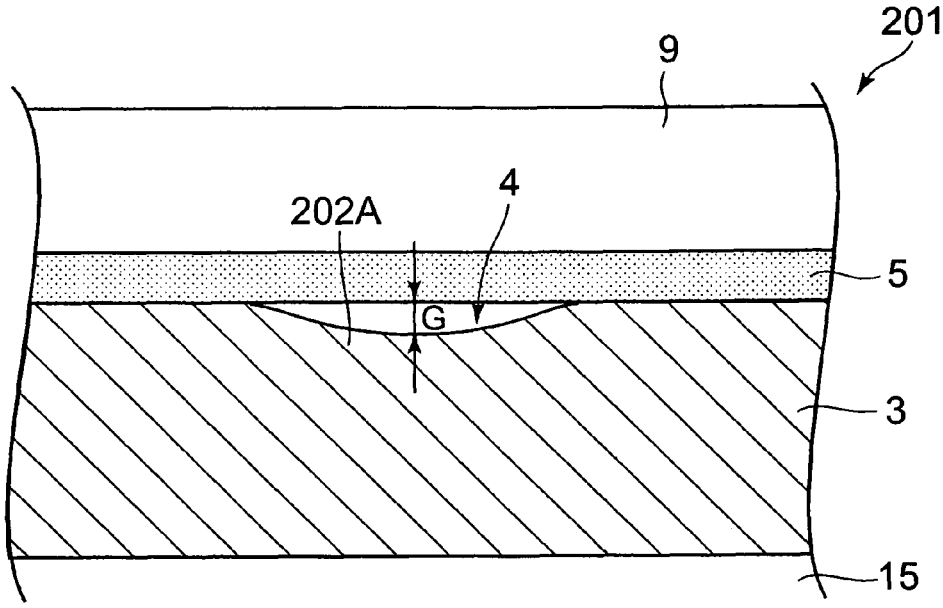
FIG. 20 is a sectional view of the thermal head of FIG. 18A taken along the arrow Q-Q.

First, as illustrated in FIG. 17A, the concave portion 2 is formed in the supporting substrate 3 in the concave portion forming step. Next, after cleaning the surface of the supporting substrate 3, as illustrated in FIG. 17B, a thin plate glass having a thickness of 5 μm to 100 μm is directly bonded onto the one surface of the supporting substrate 3 without using an adhesive at room temperature (temporary bonding step). Note that, it is desirable that the supporting substrate 3 be a substrate made of the same material as that of the thin plate glass forming the heat storage layer 5, or a glass substrate having similar characteristics.

Subsequently, as illustrated in FIG. 17C, the thin plate glass and the supporting substrate 3 (glass substrate) are fused to each other by a heating treatment, and the heat storage layer 5 is bonded onto the surface of the supporting substrate 3 (main bonding step). The heating treatment is performed at temperature ranging from a glass transition point of the thin plate glass and the supporting substrate 3 to a softening point thereof. By performing the heating treatment at temperature equal to or lower than the softening point, it is possible to keep shape accuracy of the heat storage layer 5 and the supporting substrate 3.

In the main bonding step, the hollow heat insulating layer 4 is formed, and the height of the protruding portion 2A is decreased due to expansion of gas enclosed in the hollow portion and softening of the thin plate glass and the supporting substrate 3. Thus, the gap G can be formed between the protruding portion 2A and the heat storage layer 5. Further, the gap G is formed, and the peripheral edge of the concave portion 2 of the supporting substrate 3 is chamfered, and formed as the gently curved surface. With this structure, the peripheral edge portion 302B can be formed. Note that, according to this manufacturing method, the forward end portion of the protruding portion 2A is formed as the curved surface protruding to the heat storage layer 5 side. Subsequently, as illustrated in FIG. 17D, the thinning step may be performed.

As describe above, in the temporary bonding step and the main bonding step, the gap G is formed between the protruding portion 2A and the heat storage layer 5 when the supporting substrate 3 and the heat storage layer 5 are thermally fused to each other, whereby it is possible to omit a separate step of forming the gap G. Therefore, the number of manufacturing steps is reduced, and manufacture of the thermal heads 1, 101, 201, and 301 can be simplified.

Note that, as illustrated in FIGS. 18A to 20, in the thermal head 201, with the manufacturing method C, it is possible to form the protruding portion 202A having a wall-like shape and the peripheral edge portion 302B of the concave portion 2 with easy steps.

As described above, while the embodiments of the present invention are described with reference to the drawings, the specific structure is not limited to those embodiments. The present invention also includes design modifications and the like without departing from the spirit of the present invention.

What is claimed is:

1. A thermal head, comprising:

a substrate having a surface in which a concave portion is formed;

a heat storage layer bonded onto the surface of the substrate;

a heating resistor provided in a region, which is opposed to the concave portion of the substrate, on the heat storage layer; and a deflection limiting portion, which is provided inside a hollow portion formed between the substrate and the heat storage layer by the concave portion, and comes into contact with the heat storage layer and limits deflection of the heat storage layer when the heating resistor is pressurized by predetermined load or more.

2. A thermal head according to claim 1, wherein:

the deflection limiting portion is formed into a shape protruding from a bottom surface of the hollow portion toward the heat storage layer; and the deflection limiting portion and the heat storage layer have a gap therebetween of a size allowing the heat storage layer to come into contact with the deflection limiting portion within a range in which the heat storage layer is elastically deformed.

3. A thermal head according to claim 2, wherein:

the gap between the deflection limiting portion and the heat storage layer is set to approximately 0.1 μm or more and 1 μm or less; and the heat storage layer enclosing an opening of the concave portion has a thickness of approximately 10 μm or less.

4. A thermal head according to claim 3, wherein a peripheral edge of the concave portion in the surface of the substrate is formed as a curved surface which is curved toward an inside of the concave portion in a direction of being gradually apart from the heat storage layer.

5. A printer, comprising:

the thermal head according to claim 3; and a pressure mechanism for pressing an object to be printed against a heating resistor of the thermal head.

6. A thermal head according to claim 2, wherein a peripheral edge of the concave portion in the surface of the substrate is formed as a curved surface which is curved toward an inside of the concave portion in a direction of being gradually apart from the heat storage layer.

7. A printer, comprising:

the thermal head according to claim 2; and a pressure mechanism for pressing an object to be printed against a heating resistor of the thermal head.

8. A thermal head according to claim 1, wherein a peripheral edge of the concave portion in the surface of the substrate is formed as a curved surface which is curved toward an inside of the concave portion in a direction of being gradually apart from the heat storage layer.

9. A printer, comprising:

the thermal head according to claim 8; and a pressure mechanism for pressing an object to be printed against a heating resistor of the thermal head.

10. A printer, comprising:

the thermal head according to claim 1; and a pressure mechanism for pressing an object to be printed against a heating resistor of the thermal head.

11. A manufacturing method for a thermal head, comprising:

a concave portion forming step of forming, on a surface of a substrate, a concave portion having a protruding portion on a bottom surface thereof;

a bonding step of thermally fusing a heat storage layer on the surface of the substrate, in which the concave portion is formed in the concave portion forming step; and a heating resistor forming step of forming a heating resistor on the heat storage layer so that the heating resistor is opposed to the concave portion, wherein, in the bonding step, a gap is formed between the protruding portion and the heat storage layer at a time of the thermal fusion with use of expansion of gas in the concave portion and softening of the substrate and the heat storage layer.

12. A manufacturing method for a thermal head according to claim 11, wherein, in the bonding step, the gap is formed so that the heat storage layer comes into contact with the protruding portion within a range in which the heat storage layer is elastically deformed.

13. A manufacturing method for a thermal head according to claim 12, wherein, in the bonding step, a periphery of the concave portion in the surface of the substrate is formed as a curved surface which is curved toward an inside of the concave portion in a direction of being gradually apart from the heat storage layer.

14. A manufacturing method for a thermal head according to claim 11, wherein, in the bonding step, a periphery of the concave portion in the surface of the substrate is formed as a curved surface which is curved toward an inside of the concave portion in a direction of being gradually apart from the heat storage layer.

* * * * *